US006702037B1

(12) United States Patent
Thiessen

(10) Patent No.: US 6,702,037 B1
(45) Date of Patent: Mar. 9, 2004

(54) POST POUNDER HAVING LATERAL IMPACT RESISTANT FLOATING ANVIL

(76) Inventor: Terry Thiessen, P.O. Box 2351, Strathmore, Alberta (CA), T2W 4P5

( * ) Notice: Subject to any disclaimer, the term of this patent is extended or adjusted under 35 U.S.C. 154(b) by 0 days.

(21) Appl. No.: 09/307,018

(22) Filed: May 7, 1999

(51) Int. Cl.[7] ..... B23B 45/16

(52) U.S. Cl. ..... 173/89; 173/131; 173/132; 173/210

(58) Field of Search ..... 173/131, 132, 173/89, 210, 211; 405/231, 232, 255

(56) References Cited

U.S. PATENT DOCUMENTS 834,866 A * 10/1906 Bern ..... 405/255
956,015 A * 4/1910 Woodworth ..... 173/131
2,295,489 A * 9/1942 Riemenschneider ..... 173/131
2,680,955 A * 6/1954 Templeton ..... 173/131
2,723,532 A * 11/1955 Smith ..... 173/131
3,897,835 A * 8/1975 Frederick ..... 173/131
3,961,672 A * 6/1976 Welsch et al. ..... 173/131
4,366,870 A * 1/1983 Frederick ..... 173/211
4,479,552 A * 10/1984 Chappelow, Jr. et al. ... 173/131

* cited by examiner

*Primary Examiner*—Scott A. Smith
(74) *Attorney, Agent, or Firm*—G. F. Gallinger

(57) ABSTRACT

A pile and/or post pounder utilizing a tracked floating anvil and having a continuous loop for lifting a tracked hammer. The pounder is adapted to be transported on, and powered by the hydraulic system on any mobile construction equipment. It safely holds the post in position when pounding is commenced. The continuous loop, driven by a variable speed hydraulic motor, facilitates hammering at as high a rate as possible. The utilization of a floating anvil to pound a post is made possible by a floating anvil which is able to withstand severe lateral loading which results when the top portion of the post slides laterally outwards.

7 Claims, 3 Drawing Sheets

POST POUNDER HAVING LATERAL IMPACT RESISTANT FLOATING ANVIL

FIELD OF INVENTION

This invention relates to pile and post pounders. More particularly this invention relates to a post pounder utilizing a continuous loop lift means for lifting a tracked hammer. It features a tracked floating anvil which is capable of withstanding not only vertical but severe lateral impact. Lateral impact results when a post is struck which is not in perfect alignment with the direction of the blow.

BACKGROUND OF THE INVENTION

With a conventional pile or post pounder it is necessary for an operator to hold a post beneath the hammer until the post has been driven into the ground sufficiently to remain upright and aligned beneath the hammer. Driven posts have a tendency to mushroom and split. Holding the post is dangerous. It is next to impossible to consistently squarely strike the top portion of a post. If the post gets sufficiently out of alignment with the direction of the hammer's stroke, then the top portion of the post tends to fly out laterally from beneath the hammer. What is needed is a safe means to initially hold the driven post in alignment with the direction of the hammer's stroke.

The utilization of a floating anvil solves the problem of initially holding the post while it is started into the ground. When a post is hammered into the ground, especially when it is being started it may move out of alignment. When a hammer is used to strike a floating anvil which is seated on the top of the post we can be assured that the post will be struck. However, if the post has moved out of alignment with the direction of the hammer stroke, the post will tend to fly outwardly from beneath the anvil. When the anvil is seated around and over the top portion of the post this high energy lateral motion is transferred through the anvil into the tracks. In order to reap the considerable benefits which result from pounding a post with a floating anvil what is needed is a floating anvil which has the capacity to withstand severe vertical and lateral impact. The floating anvil should also be relatively lightweight so that minimal energy of the hammer is dissipated therein.

OBJECTS AND STATEMENT OF INVENTION

It is an object of this invention to disclose a means of safely and accurately positioning and holding a post of any shape which is to be driven, beneath a hammer. It is an object of this invention to disclose a means of consistently squarely striking a driven post. It is an object of this invention to eliminate the damage—typically mushrooming and splitting—to the top end portion of a driven post. It is a further object of this invention to disclose a portable post pounder which may be lifted and lowered onto a positioned post, which is hydraulically powered, and which may be conveniently carried, by conventional mobile equipment. It is a final object of this invention to disclose a post pounder having a relatively lightweight floating anvil which has the capacity to withstand severe vertical and lateral impact.

One aspect of this invention provides for a floating anvil adopted to seat on a post in a post pounder having a hammer sliding between two upright parallel tracks comprising: an upper portion made of a hardened metal to withstand the impact of the hammer; a central portion made of a softer metal attached to the upper portion; a lower portion adapted to surround a top portion of the post and maintain it in an upright position beneath the anvil; and guide means attached to opposite sides of the floating anvil adapted to mate with and slide within the tracks.

Another aspect of this invention provides for a post pounder comprising: a frame; an upright track mounted on the frame; a floating anvil as in claim 1 positioned in the track, adapted to seat on the post; a sliding hammer positioned in the track positioned above the floating anvil; and, lift means carried by the frame to lift, and then to drop the sliding hammer; wherein use the frame is lifted to seat the floating anvil on a post positioned for driving; and then the hammer is reiteratively lifted in the track and dropped until the post is sufficiently driven into the ground.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein.

Figures 1A, 1B, 1C, 1D, 1E:
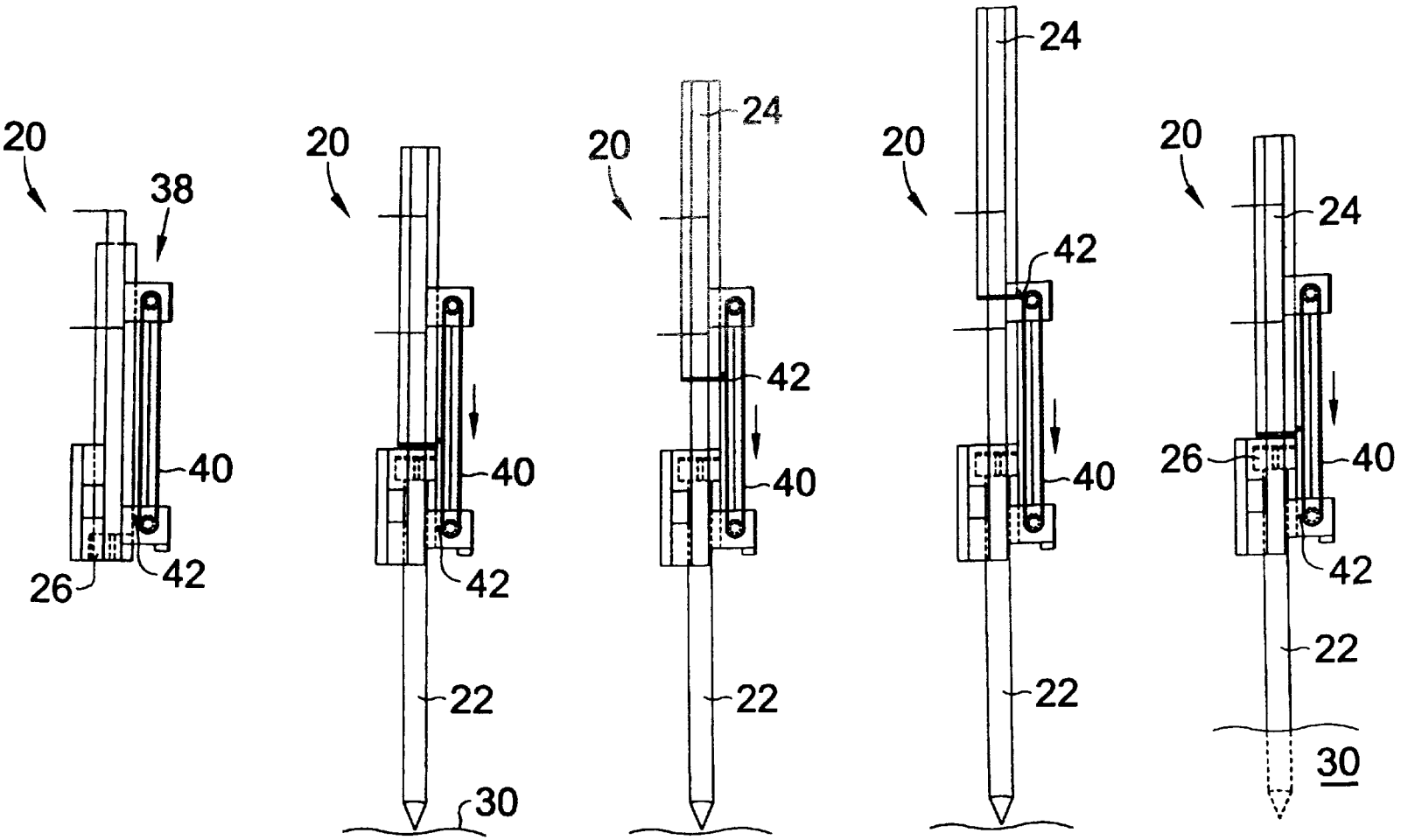
FIG. 1A is an elevational view of a post pounder without a post.
FIG. 1B is the elevational view of the post pounder shown in FIG. 1 seated on a post.
FIG. 1C is the elevational view of the post pounder shown in FIG. 1B having it hammer partially lifted.
FIG. 1D is the elevational view of the post pounder shown in FIG. 1C having its hammer fully lifted.
FIG. 1E is the elevational view of the post pounder shown in FIG. 1D after its hammer has been dropped.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention. Throughout the specification and claims herein the post pounder is defined and intended to include a pile driver.

DESCRIPTION OF THE INVENTION

Turning now to the drawings and more particularly to FIGS. 1A–1E we have elevational views of a post pounder 20 which show its operation. FIG. 1A is an elevational view of a post pounder 20 before seating on a post 22. FIG. 1B is the elevational view of the post pounder 20 shown in FIG. 1 having its tracked floating anvil 26 seated on a post 22. Lug 42 on chain 40 is in a low position. FIG. 1C is the elevational view of the post pounder 20 shown in FIG. 1B having its columnar shaped hammer 24 partially lifted by lug 42 on chain 40. FIG. 1D is the elevational view of the post pounder 20 shown in FIG. 1C having its hammer 24 fully lifted by lug 42 on chain 40. FIG. 1E is the elevational view of the post pounder 20 shown in FIG. 1D after its hammer 24 has been dropped on the tracked floating anvil 26 which is seated on a top portion of the post 22. In use the post pounder 20 is lifted and its floating anvil 26 is seated on a post 22 positioned for driving; then the hammer 24 is reiteratively lifted and dropped until the post 22 is sufficiently driven into the ground 30.

Figure 2:
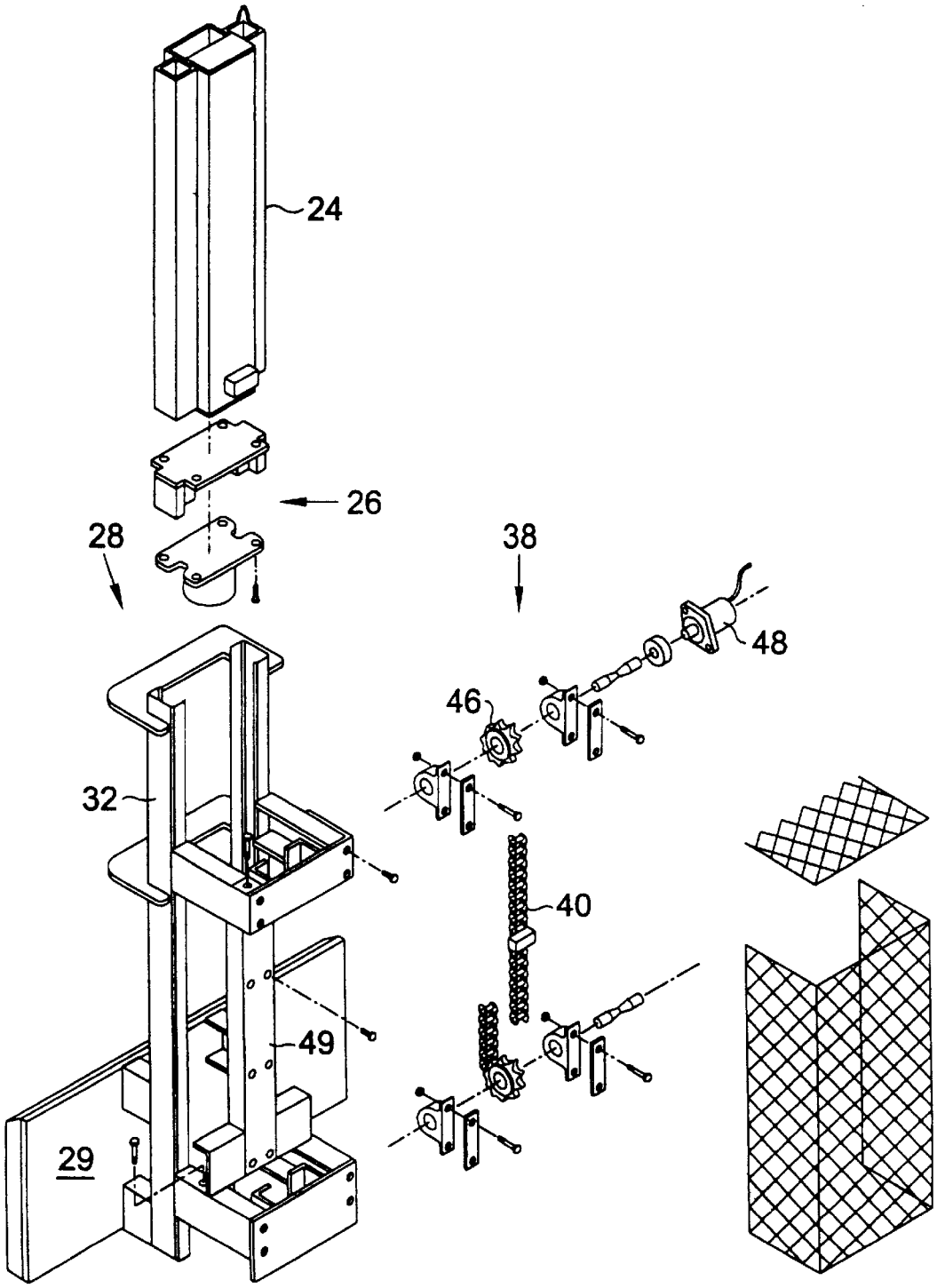
FIG. 2 is an enlarged exploded perspective view of the post pounder shown in FIG. 1.

FIG. 2 is an enlarged exploded perspective view of the post pounder 20 shown in FIG. 1. The post pounder 20 for driving a post 20 into the ground 30 comprises: a frame 28; two parallel upright tracks 32 (which most preferably are U shaped channels) mounted on the frame 28; a floating anvil 26 having opposite sides positioned in and between the tracks 32, adapted to seat on the post 22; a sliding hammer 24 having opposite sides positioned in and between the tracks 28 above the floating anvil 26; and, continuous loop lift means 38 carried by the frame 28 to lift the sliding hammer 24.

Continuous loop lift means 38 most preferably comprises a chain 40 having a projecting lug 42 adapted to engage the sliding hammer 24 so that when the chain 40 is driven, so that the sliding hammer 24 is first lifted and then dropped. The chain 40 extends between two sprockets 46 so that it has an upright lifting side. Most preferably an upright back plate 49 is positioned behind the lifting side of the chain 40 to ensure that the lug 42 linearly tracks alongside the hammer 24 for lifting without premature disengagement. Additionally, the lift means 38 preferably comprises a hydraulic motor 48. The hydraulic motor 48 may be driven by the hydraulic system on any mobile equipment used to transport the post pounder 20 including, a truck, a trailer, a bobcat, a front end loader, and a 3 point hitch (none shown). The post pounder 20 may replace the shovel on a bobcat or front end loader (none shown) by attachment to an outside portion of lower frame back member 29.

With a single hydraulic control (not shown) an operator may start, stop, and optimally select the hammering rate on a driven post 22. The sliding hammer 24 is fabricated from a square channel having a cavity which may be filled with varying amounts of ballast (usually chain) so that an optimum hammer weight may be selected for an application.

Figure 3:
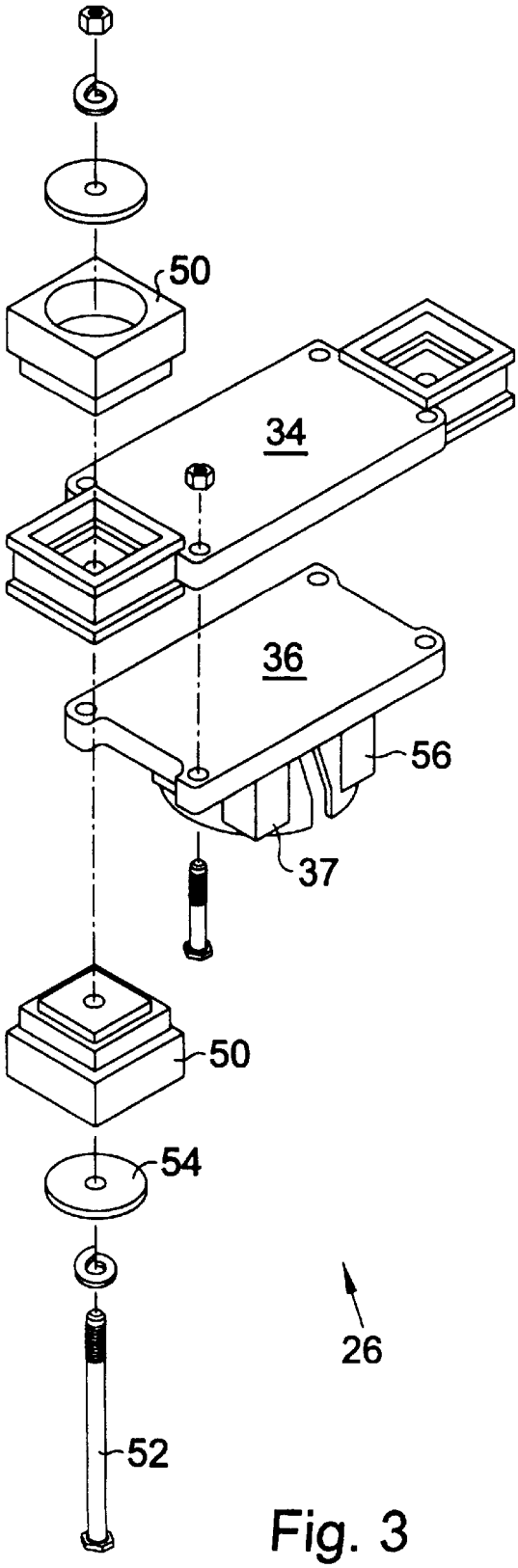
FIG. 3 is an enlarged exploded perspective view of a floating anvil which has the capacity to withstand severe vertical and lateral impact.

FIG. 3 is an enlarged perspective view of a floating anvil 26 which is adopted to seat on a post 22. The anvil 26 comprises: an upper portion 34 made of a hardened steel to withstand the impact of the hammer 24; a central portion 34 made of a soft steel bolted to the upper portion 34; a lower portion 37 configured to surround a top portion of the post 22 and maintain it in an upright position beneath the anvil 26; and guide means which are preferably bushing 50 attached to opposite sides of the upper portion 34 of the floating anvil 26.

Most preferably each oppsite side of the upper portion 34 of the anvil 26 carries an upper and lower bushing 50 The bushings 50 are preferably made of nylon and held together by a bushing attachment means which most preferably is a bushing bolt 52. It is contemplated that the bushing attachment means could include fusion of the upper and lower bushing 50. A shock absorbing rubber disk 54 insulates the bushing bolts 52 from the bushings 50. The bushing 50 are configured to prevent the upper portion 34 of the anvil 26 from contacting the tracks 32 and the bushing bolts 52.

The lower portion 37 of the anvil 26 comprises a split peripheral member which is a split ring 56, which projects downwardly to circumscribe a post 22 of a specified diameter. The ring 56 is split so that it may remain attached when the central portion 36 flexes. The split ring 56 may be welded to the central portion 36.

In the most preferred embodiment of the invention the upper portion 34 was made from a 1¼ inch thick "QT100" grade of hardened steel. The central portion was made from a ¾ inch thick soft steel. Each nylon bushing is 2¼ inches high so that the floating anvil has a 5¼ inch height and will remain upright in the track s 32 without binding. The upper portion 34 of the anvil 26 has to be hard steel to stand up to the hammer 24. When the upper portion 34 was made of soft steel it UPS curled up. Even the guide means 50 has to be attached to opposite sides of the hard upper portion 34 of the floating anvil 26. When the guide means 50 was attached to the central portion 36, it too curled under the lateral load. By experimentation it was learned that the floating anvil 26 had to have a soft steel central portion 36. When the lower portion 37 was welded to hard steel the weld broke—the hard steel did not flex. When the lower portion 37 was bolted to the anvil 26 the bolts (not shown) broke immediately. When the lower portion 37 was not split it too shattered. It was also found that it was necessary to interpose bushings 50 between the upper portion 34 and the tracks 32 to prevent deformation of the tracks 32. And without rubber disks 54 interposed between the nylon bushings 50 and the bushing bolts 52, the bushing bolts broke. Several engineering firms attempted to design the floating anvil 26, and none produced a workable floating anvil 26.

Figure 4:
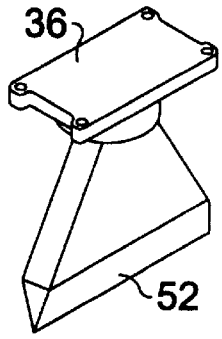
FIG. 4 is a perspective view of a lower side portion of a floating anvil comprising a flat chisel adapted to cut through asphalt.
Figure 5:
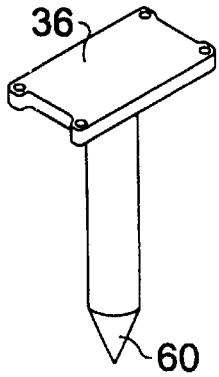
FIG. 5 is a perspective view of a lower side portion of a floating anvil comprising a chisel point used to break concrete.

FIG. 4 shows the detachable lower side portion of the floating anvil 36 having a flat chisel 52. It is adapted to cut asphalt. FIG. 5 shows the detachable lower side portion 36 of the floating anvil 26 having a conical chisel point 50. It is adapted to break concrete.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A floating anvil adopted to seat on a post in a post pounder having a hammer sliding between two upright parallel tracks comprising:

an upper portion made of a hardened metal to withstand the impact of the hammer;

a central portion made of a softer material attached to the upper portion;

a lower portion attached to and beneath the central portion, said lower portion configured to surround a top portion of the post and maintain the post in an upright position beneath the anvil;

wherein each opposite side of the upper portion of the anvil carries an upper and lower bushing, said bushings being attached together by a bushing attachment means, and wherein said bushing are configured to mate with and slide within the tracks thereby preventing the upper portion of the anvil from contacting the tracks and the bushing attachment means.

2. An anvil in claim 1 wherein the bushing attachment means comprise bolts.

3. An anvil as in claim 2 wherein the bushings are nylon and the bushing bolts are cushioned from the nylon bushings by a rubber disk.

4. An anvil as in claim 1 wherein the lower portion comprises a member which projects downwardly to circumscribe a post of a specified shape.

5. An anvil as in claim 4 wherein the upper, central and lower portions are steel.

6. An anvil as in claim 1 wherein the upper and central portions thereof are plates attached by together by bolts.

7. An anvil as in claim 6 further comprising an alternate central portion having a lower portion attached thereto comprising a chisel.

* * * * *